US008879965B2

(12) United States Patent
Kato

(10) Patent No.: US 8,879,965 B2
(45) Date of Patent: Nov. 4, 2014

(54) DEVELOPING DEVICE HAVING CONVEYER FOR CONVEYING TONER FROM TONER CHAMBER TO DEVELOPING CHAMBER

(71) Applicant: Atsushi Kato, Ichinomiya (JP)

(72) Inventor: Atsushi Kato, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 51 days.

(21) Appl. No.: 13/686,219

(22) Filed: Nov. 27, 2012

(65) Prior Publication Data

US 2013/0136507 A1 May 30, 2013

(30) Foreign Application Priority Data

Nov. 29, 2011 (JP) ..... 2011-260839

(51) Int. Cl.
*G03G 15/08* (2006.01)

(52) U.S. Cl.
CPC ..... *G03G 15/0808* (2013.01); *G03G 15/0891* (2013.01); *G03G 15/0877* (2013.01)
USPC ..... 399/263

(58) Field of Classification Search
CPC ..... G03G 15/0822; G03G 15/0865; G03G 2215/0836; G03G 2215/08; G03G 15/0808; G03G 15/0877; G03G 15/0891
USPC ..... 399/258, 262, 263
See application file for complete search history.

(56) References Cited

U.S. PATENT DOCUMENTS

| | | | | |
|---|---|---|---|---|
| 5,913,097 | A * | 6/1999 | Nakano et al. | 399/256 |
| 2003/0026629 | A1 | 2/2003 | Kawamura et al. | |
| 2006/0140673 | A1 | 6/2006 | Kamimura et al. | |
| 2007/0160392 | A1 | 7/2007 | Tsuda et al. | |
| 2008/0247784 | A1 | 10/2008 | Kakuta et al. | |
| 2008/0253810 | A1 | 10/2008 | Tateyama et al. | |
| 2008/0267668 | A1 | 10/2008 | Sakata et al. | |
| 2009/0087225 | A1 | 4/2009 | Sakuma | |
| 2009/0142116 | A1 | 6/2009 | Sato et al. | |
| 2009/0297178 | A1 | 12/2009 | Kakuta et al. | |
| 2011/0103844 | A1 | 5/2011 | Sato | |

FOREIGN PATENT DOCUMENTS

| | | | |
|---|---|---|---|
| JP | 07-199634 | A | 8/1995 |
| JP | 2003-043819 | A | 2/2003 |
| JP | 2003-307924 | A | 10/2003 |
| JP | 2006-184552 | A | 7/2006 |
| JP | 2007-183340 | A | 7/2007 |
| JP | 2008-170951 | A | 7/2008 |
| JP | 2008-256901 | A | 10/2008 |
| JP | 2008-292972 | A | 12/2008 |
| JP | 2008-304846 | A | 12/2008 |
| JP | 2009-086149 | A | 4/2009 |

(Continued)

*Primary Examiner* — Gregory H Curran

(74) *Attorney, Agent, or Firm* — Banner & Witcoff, Ltd.

(57) ABSTRACT

A developing device can supply sufficient amount of developing agent into a developing chamber regardless of residual amount of developing agent in a developing agent chamber. The developing chamber has a developing roller and a supply roller. The developing agent chamber is positioned below the developing chamber. A wall portion is positioned below and extending along a lower portion of the supply roller. A vertical conveyer is configured to convey the developing agent from the lower portion of the developing agent chamber to a position above the supply roller. The developing chamber has a reservoir positioned above the supply roller and configured to accumulate the developing agent conveyed by the vertical conveyer.

12 Claims, 4 Drawing Sheets

(56) References Cited

FOREIGN PATENT DOCUMENTS

| | | | |
|---|---|---|---|
| JP | 2009-139490 | A | 6/2009 |
| JP | 2009-222931 | A | 10/2009 |
| JP | 2009-222945 | A | 10/2009 |
| JP | 2010-009021 | A | 1/2010 |
| JP | 2010-197972 | A | 9/2010 |
| JP | 2010-204149 | A | 9/2010 |
| JP | 2010-237476 | A | 10/2010 |
| JP | 2011-022396 | A | 2/2011 |
| JP | 2011-039554 | A | 2/2011 |
| JP | 2011-095578 | A | 5/2011 |

* cited by examiner

DEVELOPING DEVICE HAVING CONVEYER FOR CONVEYING TONER FROM TONER CHAMBER TO DEVELOPING CHAMBER

CROSS REFERENCE TO RELATED APPLICATION

This application claims priority from Japanese Patent Application No. 2011-260839 filed Nov. 29, 2011. The entire content of the priority application is incorporated herein by reference.

TECHNICAL FIELD

The present invention relates to a developing device configured to supply a developing agent such as toner to a photosensitive member.

BACKGROUND

A conventional developing device has a developing chamber and a toner chamber positioned therebelow. The developing chamber accommodates therein a developing roller and a supply roller for supplying toner to the developing roller. The toner chamber accommodates therein a toner. In the toner chamber, an agitator is provided for lifting the toner in the toner chamber and for supplying the toner to the developing chamber. More specifically, the agitator includes a rotation shaft rotatably supported to the toner chamber, and a film member extending radially outwardly from the rotation shaft and slidably movable relative to an inner surface of the toner chamber. By the rotation of the rotation shaft, the film member is rotated so that the film member lifts and supplies the toner into the developing chamber through an opening formed at a boundary between the toiler chamber and the developing chamber.

SUMMARY

However, the present inventor has found that in the above-described conventional developing device, an amount of toner to be supplied to the developing chamber by the agitator may be decreased in accordance with a decrease in amount to toner in the toner chamber. Accordingly, a pressure of toner in the developing chamber becomes lowered, so that sufficient amount of toner may not be supplied to the supply roller. Thus, unevenness of printing density may occur.

Thus, it is an object of the present invention is to provide a developing device capable of supplying sufficient amount of developing agent to the developing chamber for reducing unevenness of printing density regardless of residual amount of the developing agent in the toner chamber, i.e., developing agent chamber.

This and other object of the present invention will be attained by a developing device. The developing device includes a developing chamber, a developing agent chamber, a wall portion, and a vertical conveyer. The developing chamber has a developing roller and a supply roller configured to supply developing agent to the developing roller. The supply roller has a lower portion. The developing agent chamber is positioned below the developing chamber and is configured to accommodate therein the developing agent. The developing agent chamber has a lower portion. The wall portion is positioned below and extends along the lower portion of the supply roller. The vertical conveyer is configured to convey the developing agent from the lower portion of the developing agent chamber to a position above the supply roller. The developing chamber has a reservoir positioned above the supply roller and is configured to accumulate the developing agent conveyed by the vertical conveyer.

According to another aspect, the present invention provides a developing device. The developing device includes a developing roller, a supply roller, a casing, and a first conveyer. The supply roller is configured to supply developing agent to the developing roller. The casing has a wall portion and defines an inner space therein. The wall portion divides the inner space into a developing chamber and a developing agent chamber. The developing chamber accommodates the developing roller and the supply roller and has a reservoir positioned above the supply roller. The developing agent chamber is configured to accommodate therein the developing agent and positioned below the developing chamber. The developing agent chamber has a lower portion. The first conveyer is configured to convey the developing agent from the lower portion of the developing agent chamber to the reservoir.

DETAILED DESCRIPTION

A color laser printer provided with a developing device according to an embodiment of the present invention will be described with reference to FIG. 1. Throughout the specification, the terms "upward", "downward", "upper", "lower", "above", "below", "beneath", "right", "left", "front", "rear" and the like will be used assuming that the color printer is disposed in an orientation in which it is intended to be used. More specifically, in FIG. 1 a right side and a left side are a rear side and a front side, respectively.

[Overall Structure of Color Printer]

Figure 1:
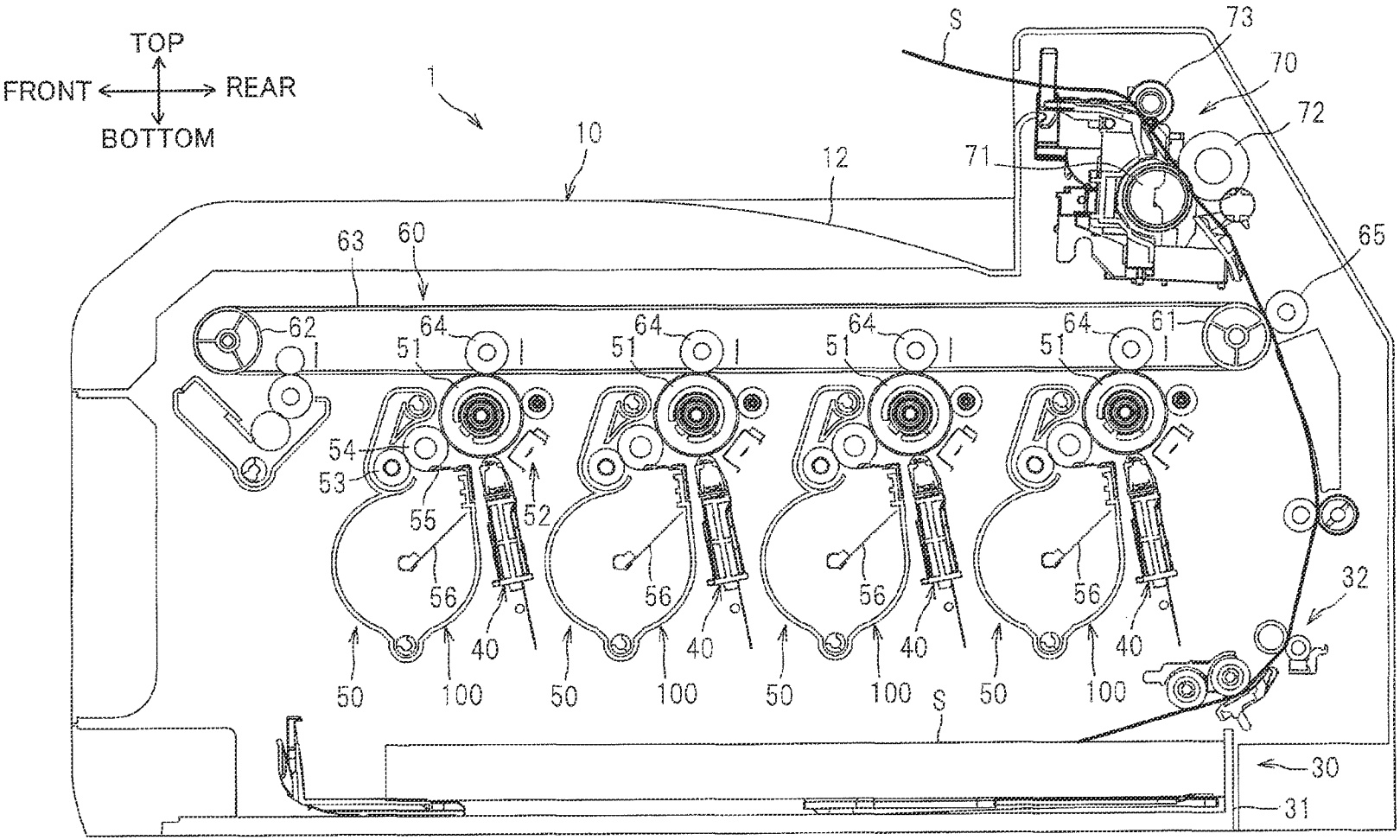
FIG. 1 is a schematic cross-sectional view of a color printer provided with a developing cartridge according to an embodiment of the present invention.

In FIG. 1, the color printer 1 has a main frame 10 in which a sheet supply unit 30, four LED units 40, four process units 50, a transfer unit 60, and a fixing unit 70 are provided. The main frame 10 has an upper portion provided with a discharge tray 12 for receiving sheets S discharged out of the main frame 10.

The sheet supply unit 30 is located at a lower portion in an interior of the main frame 10, and includes a sheet supply tray 31 for accommodating a stack of sheets S, and a sheet supplying mechanism 32 for supplying each one of the sheets S in the sheet supply tray 31 to an image transfer position (a sheet nip position defined between an intermediate transfer belt 63 and a secondary transfer roller 65 described later).

Each LED unit 40 is positioned below a photosensitive drum 51 and in confrontation therewith. The LED unit 40 has a tip end portion provided with a plurality of light emitting portions (LED) arrayed in an axial direction of the photosensitive drum 51. The axial direction is a widthwise direction or lateral direction of the printer 1. The LED unit 40 is configured to permit the light emitting portions to blink on and off based on image data, so that an outer peripheral surface of the photosensitive drum 51 uniformly charged is exposed to light, thereby forming an electrostatic latent image on the outer peripheral surface based on the image data.

The process units 50 are positioned above the sheet supply unit 30 and are arrayed in a frontward/rearward direction of the printer 1. Each process unit 50 includes the photosensitive drum 51, a charger 52, and a developing cartridge 100. The developing cartridge 100 includes a supply roller 53, a developing roller 54, a thickness regulation blade 55, and an agitator 56. Details of the developing cartridge 100 will be described later.

The transfer unit 60 is positioned above the process units 50, and includes a drive roller 61, a driven roller 62, the endless intermediate transfer belt 63 mounted on the drive and driven rollers 61, 62 under tension, four primary transfer rollers 64 each confronting each photosensitive drum 51 through the intermediate transfer belt 63, and the secondary transfer roller 65 confronting the drive roller 61 through the intermediate transfer belt 63.

With the process unit 50 and the transfer unit 60 thus constructed, after the surface of the photosensitive drum 51 is uniformly charged by the charger 52, the surface is exposed to light by the LED unit 40 to form an electrostatic latent image based on the image data on the outer peripheral surface of the photosensitive drum 51. Further, toner T accommodated in the developing cartridge 100 is triboelectrically charged by way of agitation of the toner by the agitator 56, and the charged toner is supplied to the surface of the developing roller 54 through the supply roller 53. The toner T supplied to the developing roller 54 is entered into a gap between the thickness regulation blade 55 and the developing roller 54 in accordance with the rotation of the developing roller 54, so that the toner T is further triboelectrically charged, while being carried on the surface of the developing roller 54 in a form of a toner layer having a uniform thickness.

The toner T carried on the surface of the developing roller 54 is supplied to the electrostatic latent image on the photosensitive drum 51. Thus, the electrostatic latent image becomes a visible toner image of each color. The toner image on each photosensitive drum 51 is successively transferred onto the intermediate transfer belt 63 in a superposed fashion. Then, the toner image on the intermediate transfer belt 63 is transferred onto the sheet S when the sheet S moves past the image transfer position defined between the intermediate transfer belt 63 and the secondary transfer roller 65.

The fixing unit 70 is positioned above the transfer unit 60, and includes a heat roller 71, a pressure roller 72 positioned in confrontation with the heat roller 71 and pressing thereagainst, and a discharge roller 73 adapted to discharge image fixed sheet S out of the main frame 10. The toner image carried on the sheet S is thermally fixed to the sheet S when the sheet passes through a nip region between the heat roller 71 and the pressure roller 72, and the image fixed sheet is discharged onto the discharge tray 12 by the discharge roller 73.

[Details of Developing Cartridge]

Figure 2:
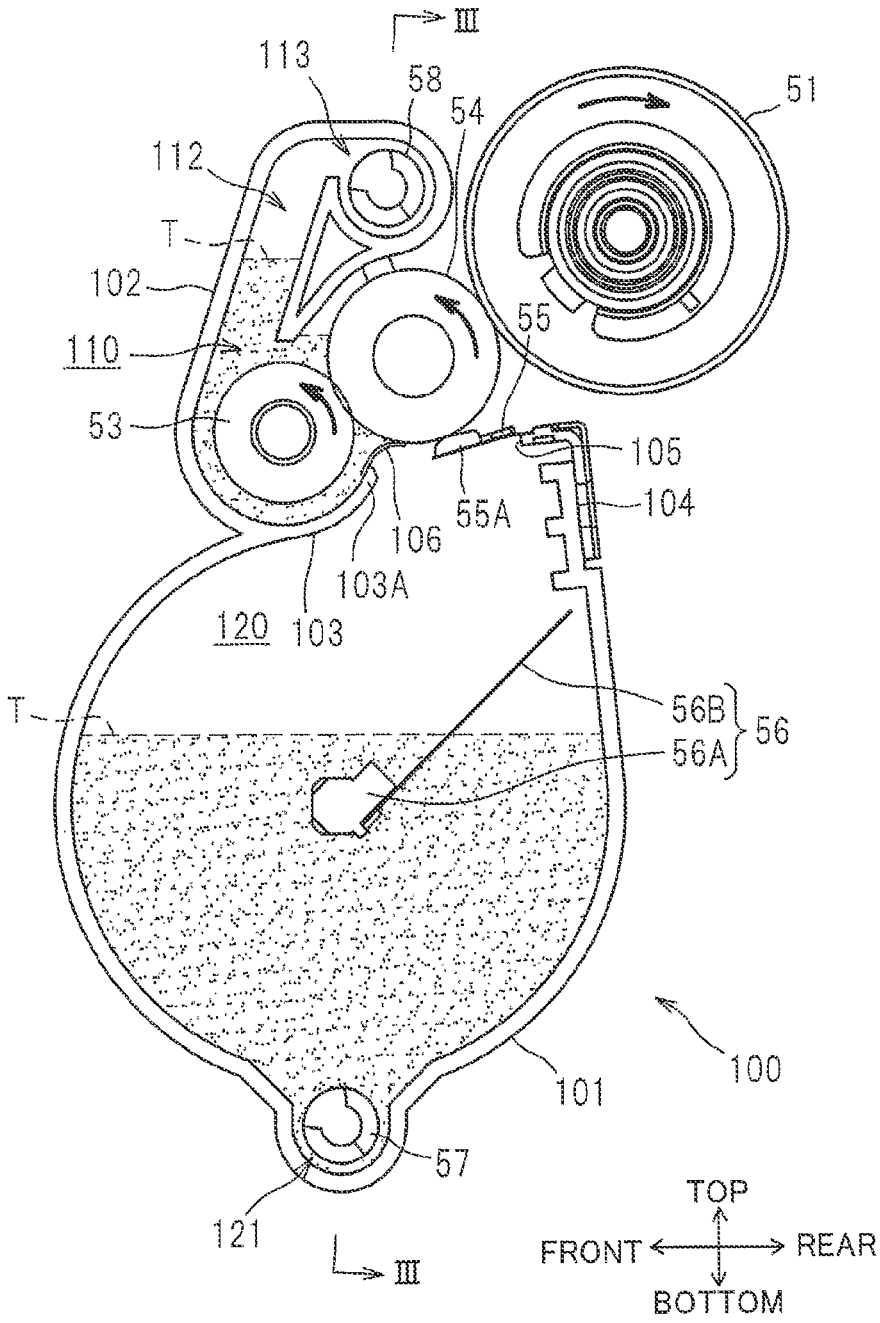
FIG. 2 is a cross-sectional view of the developing cartridge according to the embodiment and a photosensitive drum.
Figure 3:
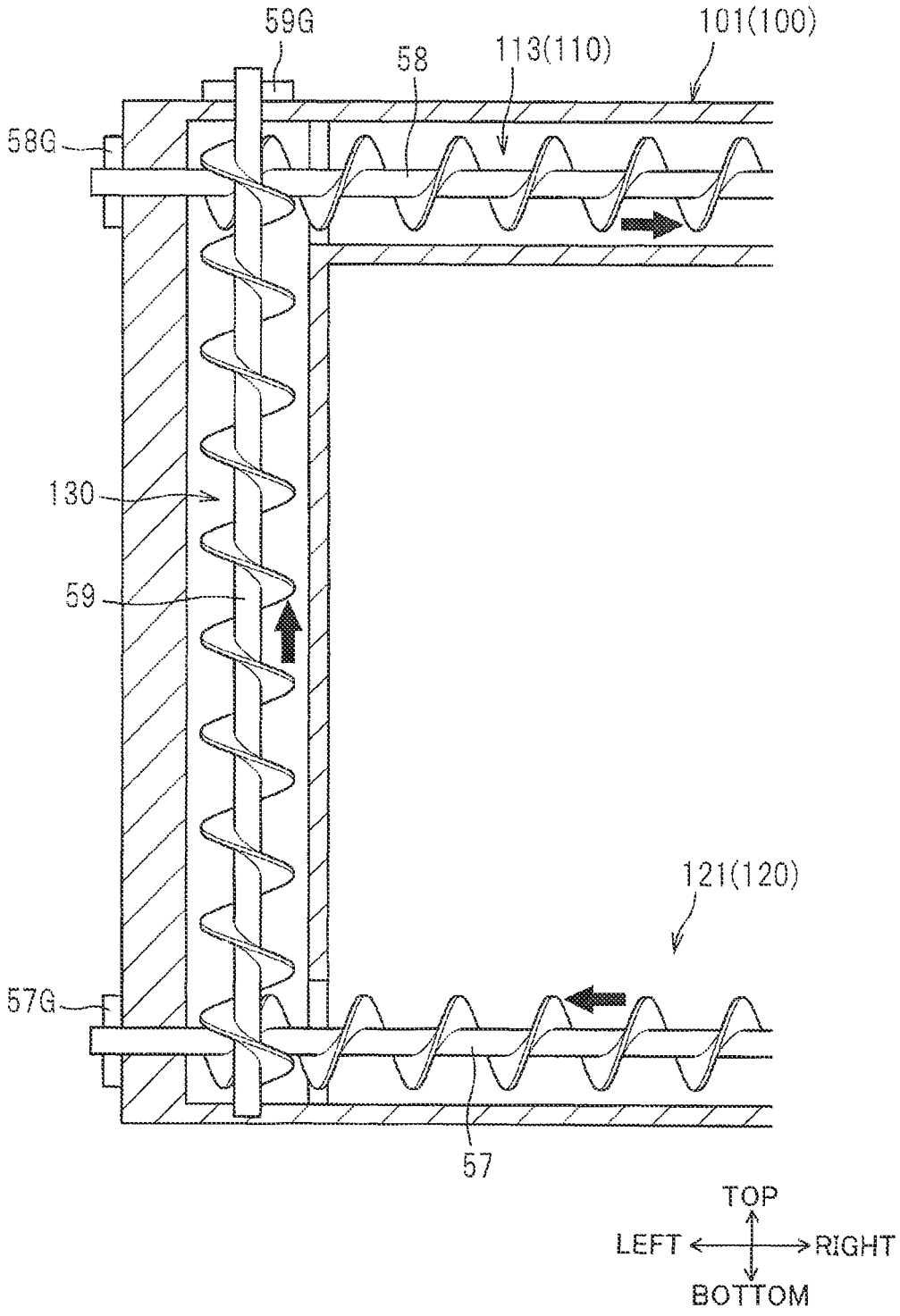
FIG. 3 is a cross-sectional view taken along line III-III in FIG. 2 and particularly showing a casing, a first auger, a second auger, and a third auger in the developing device according to the embodiment.

As shown in FIGS. 2 and 3, the developing cartridge 100 includes a casing 101 provided with a developing chamber 110, a toner chamber 120, and a communication tube 130. The toner chamber 120 is positioned below the developing chamber 110 for accommodating toner T. The communication tube 130 is positioned leftward of the developing chamber 110 and the toner chamber 120, and is adapted to provide communication between an upper portion of the developing chamber 110 and a lower portion of the toner chamber 120. The toner chamber 120 serves as a developing agent chamber of the present invention.

The supply roller 53, the developing roller 54, the thickness regulation blade 55 and a second auger 58 are provided in the developing chamber 110. The agitator 56 and a first auger 57 are provided in the toner chamber 120. A third auger 59 is provided in the communication tube 130. The first auger 57 serves as a first horizontal conveyer and a second conveyer of the present invention. The second auger 58 serves as a second horizontal conveyer and a third conveyer of the present invention. The third auger 59 serves as a vertical conveyer and a first conveyer of the present invention.

The casing 101 of the developing cartridge 100 includes a fro 102, a rear wall 104, and a partition wall 103 extending rearward from a vertically intermediate portion of the front wall 102. The partition wall 103 divides an interior of the casing 101 into the developing chamber 110 and the toner chamber 120. The partition wall 103 serves as a wall portion of the present invention.

The developing chamber 110 has a rear opening through which the developing roller 54 is exposed to an outside. The supply roller 53 is positioned diagonally downward and frontward of the developing roller 54, and is in contact with the developing roller 54 at a position above the partition wall 103.

The partition wall 103 is arcuate shaped in conformance with a lower contour of the supply roller 53, and has a rear end portion 103A extending diagonally upward and rearward to a position rearward of the supply roller 53. With this structure, toner T can be accumulated around the supply roller 53. A communication opening 105 is defined by the rear end portion 103A and the rear wall 104 for providing communication between the developing chamber 110 and the toner chamber 120. Further, a part (a lower portion) of the developing roller 54 is in confrontation with the toner chamber 120 through the communication opening 105 in vertical direction.

A resiliently flexible film 106 is provided at the rear end portion 103A of the partition wall 103. The film 106 has a front end portion fixed to the rear end portion 103A of the partition wall 103, and a rear end portion in contact with the developing roller 54 from below at a position upstream of a contacting portion between the developing roller 54 and the thickness regulation blade 55 in a rotational direction of the developing roller 54. The film 106 serves as a lid member of the present invention.

The film 106 will be flexed down when a toner pressure in the developing chamber 110 exceeds a predetermined pressure upon accommodation of toner by a predetermined amount in the developing chamber 110. With the resilient deformation of the film 106, the rear end portion of the film 106 is moved downward away from the developing roller 54.

The thickness regulation blade 55 is in contact with an outer peripheral surface of the developing roller 54 from below. More specifically, the thickness regulation blade 55 has a base end portion supported to the rear wall 104, and a free end portion positioned below the developing roller 54. The free end portion has a contacting portion 55A in contact with the developing roller 54 at a position in confrontation with the toner chamber 120. That is, the contacting portion 55A is positioned above the communication opening 105.

The developing chamber 110 has a toner reservoir 112 for pooling the toner T and a second auger container 113 at a position above the supply roller 53.

The toner reservoir 112 is tubular shaped and is adapted to accumulate toner T above the supply roller 53. The toner reservoir 112 has a bottom end opened above the supply roller 53 so as to supply toner in the toner reservoir 112 to a region around the supply roller 53.

The second auger container 113 is positioned at an upper portion of the toner reservoir 112 and rearward of the toner reservoir 112. As shown in FIG. 3, the second auger container 113 is elongated laterally and tubular shaped, and is in communication with an upper portion of the communication tube 130. The second auger container 113 has a front opening providing communication with the toner reservoir 112, as shown in FIG. 2.

The second auger 58 is disposed in the second auger container 113, and is rotatably supported to the casing 101. The second auger 58 extends over a lateral length of the casing 101, and is configured to convey toner T in the second auger container 113 rightward by the rotation of the second auger 58. That is, the second auger 58 conveys toner T conveyed by the third auger 59 toward the toner reservoir 112 of the developing chamber 110 while the toner T on the second auger 58 is uniformly distributed along a length thereof.

The toner chamber 120 is generally hollow cylindrical, and has an upper portion formed with the communication opening 105 to communicate with the developing chamber 110. The agitator 56 is disposed in the toner chamber 120

The agitator 56 includes an agitator shaft 56A rotatably supported to the casing 101, and a flexible film member 56B extending radially outwardly from the agitator shaft 56A and in sliding contact with an inner surface of the casing 101 upon rotation of the agitator shaft 56A. Thus, toner T in the toner chamber 120 is agitated by the rotation of the agitator 56.

The toner chamber 120 has a bottom wall provided with a recessed portion 121 recessed downward. The first auger 57 is disposed in the recessed portion 121.

The first auger 57 is rotatably supported to the casing 101, and extends over the lateral length of the casing 101. Upon rotation of the first auger 57, toner T around the first auger 57 is conveyed leftward. That is, the first auger 57 is configured to convey toner T at the bottom portion of the toner chamber 120 to the third auger 59 disposed in the communication tube 130.

As shown in FIG. 3, the communication tube 130 is positioned at a left end portion of the casing 101, and is tubular shaped elongated in vertical direction. The communication tube 130 has an upper portion fluidly connected to the upper portion of the developing chamber 110, i.e., to the second auger container 113, and has a lower portion fluidly connected to the lower portion of the toner chamber 120, i.e., to the recessed portion 121. Thus, the communication tube 130 is communicated with the developing chamber 110 and the toner chamber 120.

As described above, the third auger 59 is disposed in the communication tube 130 and is rotatably supported to the casing 101. The third auger 59 extends over a vertical length of the communication tube 130, and is configured to convey toner T conveyed into the communication tube 130 upward, i.e., to the second auger container 113.

Next, a mechanism for driving the supply roller 53, the developing roller 54, and each auger 57, 58, 59 will be described with reference to FIGS. 3 and 4.

The first auger 57 and the second auger 58 have rotation shafts whose left end portions protrude outward from the casing 101. A first auger gear 57G is fixed to the protruding part of the rotation shaft of the first auger 57, and a second auger gear 58G is fixed to the protruding part of the rotation shaft of the second auger 58. Thus, the first and second auger gears 57G, 58G are rotatable together with the rotation of the rotation shafts of the first and second auger 57, 58, respectively.

The third auger 59 has a rotation shaft whose upper end portion protrudes outward from the casing 101. A third auger gear 59G is fixed to the protruding part of the rotation shaft of the third auger 59, so that the third auger gear 59G is rotatable together with the rotation of the rotation shaft of the third auger 59.

A gear train (not shown) is provided so as to drivingly connect the first through third auger gears 57G, 58G, 59G, together. Further as shown in FIG. 4, a second input gear 150 is provided at the developing cartridge 100, and the third auger gear 59G is in meshing engagement with the second input gear 150. With this structure, by the rotation of the second input gear 150, driving force is transmitted to the third auger gear 59G, so that the first and second auger gears 57G and 58G are also rotated together with the rotation of the third auger gear 59G.

A supply roller gear 53G is fixed to one end portion of a rotation shaft of the supply roller 53, and a developing roller gear 54G is fixed to one end portion of a rotation shaft of the developing roller 54, so that these gears 53G and 54G are rotatable together with the rotation of the rotation shafts of the supply roller 53 and the developing roller 54, respectively.

Figure 4:
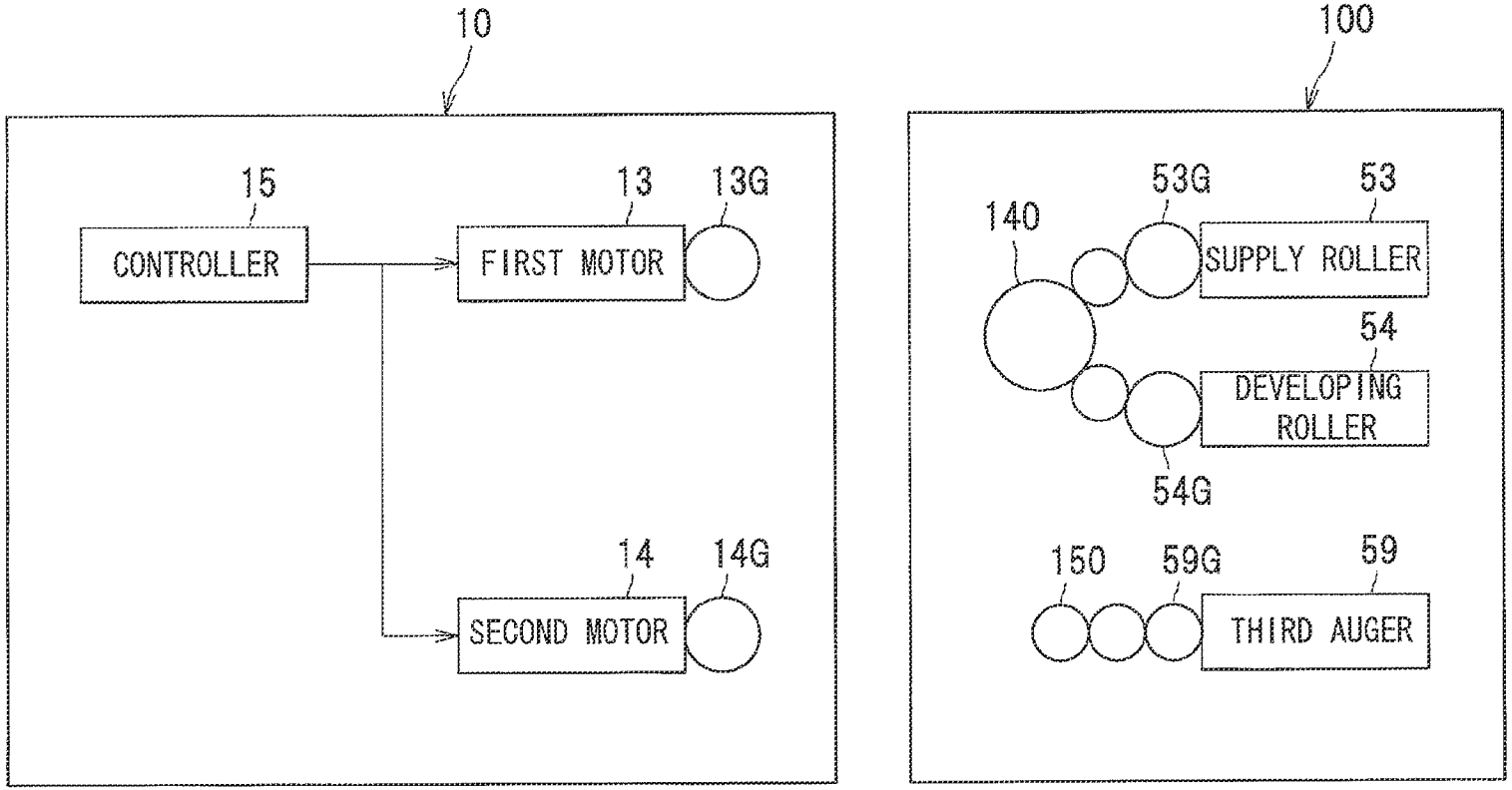
FIG. 4 is a view for description of a system for driving a supply roller, a developing roller, and the third auger.

Further, as shown in FIG. 4, a first input gear 140 independent of the second input gear 150 is provided at the developing cartridge 100, and the supply roller gear 53G and the developing roller gear 54G are in meshing engagement with the first input gear 140. With this structure, the supply roller gear 53G and the developing roller gear 54G are rotatable concurrently by the rotation of the first input gear 140. Since the first and second input gears 140 and 150 are provided independent of each other, driving to the third auger 59 can be performed independent of the driving to the supply roller 53 and the developing roller 54.

In the main frame 10, a first motor 13, first output gears 13G, a second motor 14, second output gears 14G, and a controller 15 are provided. Each first output gear 13G and each second output gears 14G are provided for each developing cartridge 100.

The first output gear 13G is configured to meshedly engaged with the first input gear 140 upon assembly of the developing cartridge 100 to the main frame 10. The first output gear 13G is rotated by the driving force from the first motor 13.

The second output gear 14G is configured to meshedly engaged with the second input gear 150 upon assembly of the developing cartridge 100 to the main frame 10. The second output gear 14G is rotated by the driving force from the second motor 14.

The controller 15 includes a CPU, a RAM and a ROM (those not shown) and is configured to control driving of the first and second motors 13 and 14 based on a control program stored in advance.

More specifically, during image forming operation, the controller 15 drives the first motor 13 and the second motor 14, and drives the first motor 13 while stopping the second motor 14 at a predetermined timing at which image forming operation is suspended. Incidentally, an example of "predetermined timing" is a using timing after elapse of predetermined time period counting from the previous using timing of the printer 1.

Operation and advantages in the above-described embodiment will be described. For the image forming operation, the controller 15 drives the first and second motors 13 and 14.

Accordingly, the supply roller 53, the developing roller 54, the first auger 57, the second auger 58, and the third auger 59 are rotated.

As shown in FIG. 3, toner T in the toner chamber 120 is conveyed by the rotation of the first auger 57 to the third auger 59 in the communication tube 130. The toner T is then conveyed upward by the third auger 59 within the communication tube 130, and conveyed into the developing chamber 110, i.e., into the second auger container 113 by the second auger 58.

Toner T conveyed to the second auger container 113 is supplied to the supply roller 53 through the toner reservoir 112.

In this way, toner T can be conveyed from the lower portion of the toner chamber 120 to the upper portion of the supply roller 53. Accordingly, sufficient amount of toner T can be supplied to the developing chamber 110 regardless of the residual amount of the toner in the toner chamber 120.

Because the toner reservoir 112 is positioned above the supply roller 53, toner T conveyed by the third auger 59 can be accumulated at a position above the supply roller 53. Consequently, high toner pressure around the supply roller 53 can be maintained to reduce unevenness of imaging density in comparison with an imaginary structure where a toner reservoir is positioned beside the supply roller 53.

Incidentally, if deposition amount of toner T in the developing chamber 110 is increased to increase toner pressure in the developing chamber 110, the film 106 is flexed, so that the toner T falls into the toner chamber 120 through the communication opening 105. With this structure, a constant level of the toner in the developing chamber 110 can be provided to control the toner pressure or maintain a constant toner pressure in the developing chamber 110.

Toner T supplied to the supply roller 53 is supplied to the developing roller 54 as a result of contacting rotation of the supply roller 53 and the developing roller 54. Excessive amount of toner carried on the developing roller 54 is scraped off from the developing roller 54 by the thickness regulation blade 55. Since the communication opening 105 is positioned below the contacting portion 55A of the thickness regulation blade 55, toner T scraped off by the thickness regulation blade 55 is not directed to the developing chamber 110 but is fallen onto the toner chamber 120 through the communication opening 105. In this way, toner circulation is performed between the developing chamber 110 and the toner chamber 120.

Further, since the agitator 56 is rotated in the toner chamber 120, toner T fallen into the toner chamber 120 from the developing chamber 110 can be mixed with toner T in the toner chamber 120 by the agitator 56.

Upon reaching predetermined timing, the controller 15 drives the first motor 13 while stops the second motor 14, so that the supply roller 53 and the developing roller 54 are rotated while rotation of the first through third augers 57, 58, 59 is stopped. As a result, after the toner T in the developing chamber 110 is supplied to the developing roller 54 while the toner supply to the developing chamber 110 is not performed, the toner is scraped off from the developing roller 54 by the thickness regulation blade 55. In this way, after the toner T in the developing chamber 110 is returned to the toner chamber 120, toner T is supplied to the developing chamber 110 by the first through third augers 57, 58, 89 for the image formation. Consequently, toner T in the developing chamber 110 can be replaced with toner charged in the toner chamber 120.

Various modifications are conceivable. In the above-described embodiment, the first and second augers 57, 58 are employed. However, instead of these augers, endless belts are available. More specifically, each endless belt has an outer surface provided with a plurality of ribs extending in a direction perpendicular to the circulating direction of the belt. In the latter case, each pair of rollers is rotatably supported to the casing, and each endless belt is mounted on these rollers under tension.

Further, in the above-described embodiment, the film 106 is provided as a lid member. However, instead of the film, a thin rubber sheet is available.

Further, in the above-described embodiment, the agitator 56 including the agitator shaft 56A and the film member 56B is employed as an agitation member. However, an integrally formed agitation member is also available in which plate like members extends radially outwardly from and integrally with a shaft.

Further, instead of the color printer 1, other image forming device such as a monochromatic printer, a copying machine and a multi-function device are also available.

While the invention has been described in detail with reference to the embodiments thereof, it would be apparent to those skilled in the art that various changes and modifications may be made therein without departing from the spirit of the invention.

What is claimed is:

1. A developing device comprising:

a developing chamber having a developing roller and a supply roller configured to supply developing agent to the developing roller, the supply roller having a lower portion;

a developing agent chamber positioned below the developing chamber and configured to accommodate therein the developing agent, the developing agent chamber having a lower portion;

a wall portion positioned below and extending along the lower portion of the supply roller; and a vertical conveyer configured to convey the developing agent from the lower portion of the developing agent chamber to a position above the supply roller, the developing chamber having a reservoir positioned above the supply roller and configured to accumulate the developing agent conveyed by the vertical conveyer.

2. The developing device as claimed in claim 1, wherein the developing chamber and the developing agent chamber communicate with each other through a communication opening, wherein the developing roller has a lower portion in confrontation with the developing agent chamber in a vertical direction through the communication opening, and wherein the developing device further comprises a thickness regulation blade in contact with the lower portion of the developing roller and configured to regulate a thickness of a layer of the developing agent carried on the developing roller.

3. The developing device as claimed in claim 2, wherein the wall portion has an end portion positioned adjacent to the developing roller, wherein a gap is defined between the end portion of the wall portion and the developing roller, and wherein the developing device further comprises a lid member having one end portion fixed to the end portion of the wall portion and another end portion in contact with the lower portion of the developing roller, the lid member being resiliently flexible and configured to block the gap.

4. The developing device as claimed in claim 2, wherein the vertical conveyer is configured to be driven independent of driving of the developing roller and the supply roller.

5. The developing device as claimed in claim 2, further comprising an agitator provided in the developing agent chamber so as to agitate the developing agent in the developing agent chamber.

6. The developing device as claimed in claim 1, wherein the developing agent chamber further includes a first horizontal conveyer configured to convey the developing agent toward the vertical conveyer in an axial direction of the developing roller, and wherein the developing chamber further includes a second horizontal conveyer configured to convey the developing agent conveyed by the vertical conveyer in the axial direction to supply the developing agent toward the supply roller.

7. A developing device comprising:

a developing roller;

a supply roller configured to supply developing agent to the developing roller;

a casing having a wall portion and defining an inner space therein, the wall portion dividing the inner space into a developing chamber and a developing agent chamber, the developing chamber accommodating the developing roller and the supply roller and having a reservoir positioned above the supply roller, the developing agent chamber configured to accommodate therein the developing agent and positioned below the developing chamber, the developing agent chamber having a lower portion; and a first auger having a vertical rotational axis to rotate to convey the developing agent from the lower portion of the developing agent chamber to the reservoir.

8. The developing device as claimed in claim 7, wherein the developing chamber and the developing agent chamber communicate with each other through a communication opening, wherein the developing roller has a lower portion in confrontation with the developing agent chamber in a vertical direction through the communication opening, and wherein the developing device further comprises a thickness regulation blade in contact with the lower portion of the developing roller and configured to regulate a thickness of a layer of the developing agent carried on the developing roller.

9. The developing device as claimed in claim 8, wherein the wall portion has an end portion positioned adjacent to the developing roller, wherein a gap is defined between the end portion of the wall portion and the developing roller, and wherein the developing device further comprises a lid member having one end portion fixed to the end portion of the wall portion and another end portion in contact with the lower portion of the developing roller, the lid member being resiliently flexible and configured to block the gap.

10. The developing device as claimed in claim 8, wherein the first auger is configured to be driven independent of driving of the developing roller and the supply roller.

11. The developing device as claimed in claim 8, further comprising an agitator provided in the developing agent chamber so as to agitate the developing agent in the developing agent chamber.

12. The developing device as claimed in claim 7, wherein the developing agent chamber further includes a second auger having a rotational axis to rotate to convey the developing agent toward the first auger, and wherein the developing chamber further includes a third auger having a rotational axis to rotate to convey the developing agent conveyed by the first auger to supply the developing agent toward the supply roller.

* * * * *